US007798340B2

(12) United States Patent
Lin et al.

(10) Patent No.: US 7,798,340 B2
(45) Date of Patent: Sep. 21, 2010

(54) RACK APPARATUS WITH RETAINING MEMBER FOR USE IN ANODIZING

(75) Inventors: Chih-Pen Lin, Taipei Hsien (TW); Hung-Chang Lee, Taipei Hsien (TW); Yu-Chuan Chen, Shenzhen (CN); Yong Zhang, Shenzhen (CN); Xiao-Lin Wu, Shenzhen (CN); Zhan-Gang Zhu, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 530 days.

(21) Appl. No.: 11/777,139

(22) Filed: Jul. 12, 2007

(65) Prior Publication Data

US 2008/0142461 A1 Jun. 19, 2008

(30) Foreign Application Priority Data

Dec. 15, 2006 (CN) ..... 2006 1 0157532

(51) Int. Cl.
*A47F 5/08* (2006.01)

(52) U.S. Cl. ..... 211/113; 204/297.06; 204/297.07; 204/297.09

(58) Field of Classification Search ..... 211/8, 211/113, 85.31, 119, 181.1, 13.1; 118/503, 118/505, 500, 504; 204/288.6, 297.06, 297.07, 204/297.1

See application file for complete search history.

(56) References Cited

U.S. PATENT DOCUMENTS

| | | | | | |
|---|---|---|---|---|---|
| 1,281,762 | A * | 10/1918 | Carpenter | 118/503 |
| 1,755,122 | A * | 4/1930 | Lichtman | 204/297.1 |
| 2,258,391 | A * | 10/1941 | Novitsky | 204/297.1 |
| 2,505,212 | A * | 4/1950 | Schneider | 204/297.09 |
| 2,858,266 | A * | 10/1958 | Schneider | 204/297.09 |
| 2,999,802 | A * | 9/1961 | Gault | 204/297.1 |
| 3,033,776 | A * | 5/1962 | Rosner | 204/297.09 |
| 3,042,605 | A * | 7/1962 | Belke | 204/297.1 |
| 3,118,545 | A * | 1/1964 | Rosner | 211/117 |
| 3,326,389 | A * | 6/1967 | Richter, Jr. | 211/86.01 |
| 3,366,567 | A * | 1/1968 | Elbaum | 204/297.07 |
| 3,596,585 | A * | 8/1971 | Lewandowski | 396/652 |
| 3,607,707 | A * | 9/1971 | Chenevier | 204/297.1 |
| 4,872,963 | A * | 10/1989 | Van Horn | 204/297.09 |
| 5,188,241 | A * | 2/1993 | Kobza et al. | 211/59.1 |
| 2008/0149577 | A1 * | 6/2008 | Lin et al. | 211/85.31 |

* cited by examiner

*Primary Examiner*—Darnell M Jayne
*Assistant Examiner*—Stanton L Krycinski
(74) *Attorney, Agent, or Firm*—Jeffrey T. Knapp

(57) ABSTRACT

A rack apparatus (100) includes a frame (10), a plurality of supporting members (106), and a plurality of retaining members (12). The supporting members are arranged/mounted on/to the frame. The retaining members are mounted on the supporting members. Each retaining member includes a fixing piece (120) and two supporting pieces (122, 124). The fixing piece has a notched mounting portion. The two supporting pieces are respectively positioned at an opposite side of the fixing piece. Each supporting piece forms a retaining portion (i.e., a through hole therein). The notched mounting portion and the retaining portions together help retain a workpiece within a given retaining member.

15 Claims, 8 Drawing Sheets

RACK APPARATUS WITH RETAINING MEMBER FOR USE IN ANODIZING

BACKGROUND OF THE INVENTION

1. Field of the Invention

The present invention relates to a rack apparatus and, particularly, to a rack apparatus used for retaining workpieces during anodizing.

2. Description of Related Art

Anodizing technology is widely used in plating of workpieces. During anodizing, metal workpieces need to be held on rack apparatuses. The rack apparatuses are made up of a plurality of retaining members. Referring to FIG. 7, a known retaining member 50 is made of a resilient (i.e., capable of elastic deformation followed by a return to its previous shape) metal and includes a bracket 502 and two extending plates 504, 506. The bracket 502 is approximately U-shaped. The extending plates 504, 506 are respectively connected to the two corresponding ends of the bracket 502 and extend along the same direction as the two ends of the bracket 502. A distal end of each extending plate 504, 506 is warped/bent outwardly.

Referring to FIG. 8, the retaining member 50 is used to retain a workpiece 60 requiring plating. The workpiece 60 is, for example, a metal board. The metal board is substantially a rectangular and has two bent edges 602, 604 that are formed at two shorter sides thereof. The bent edges 602, 604 are L-shaped, with the long edge of the "L" extending essentially perpendicularly from a corresponding shorter side. Two tabs 606, 608 extend from one longer side of the workpiece 60. In use, the extending plates 504, 506 of the retaining member 50 are able to lock into a respective one of the bent edges 602, 604 of the workpiece 60, so as to fix the workpiece 60 to the rack apparatus.

However, although the retaining member 50 with the workpiece 60 may be fixed, the bent angle of the extending plates 504, 506 is difficult to adjust. Accordingly, the extending plates 504, 506 are difficult to engage tightly with the bent edges 602, 604. In addition, the fixturing configuration between the extending plates 504, 506 and the workpiece 60 does not provide a large holding force. When anodizing, if the workpiece 60 is affected by shaking, the workpiece 60 may quite possibly become dislodged from the rack apparatus.

Therefore, an improved rack apparatus with retaining members is desired in order to overcome the above-described shortcomings.

SUMMARY OF THE INVENTION

In one aspect, a retaining member includes a fixing piece and two supporting pieces. The fixing piece has a mounting portion. The mounting portion has a receiving notch therein. The two supporting pieces are respectively positioned at an opposite side of the fixing piece. Each supporting piece forms a retaining portion. The mounting portion and the retaining portions together are configured for retain a workpiece therebetween. The receiving notch of the mounting portion is configured for facilitating the positioning of the workpiece.

In another aspect, a rack apparatus includes a frame, a plurality of groups of supporting members, and a plurality of retaining members. The supporting members are arranged on the frame. The retaining members are mounted on the supporting members. Each retaining member includes a fixing piece and two supporting pieces. The fixing piece has a notched mounting portion. The two supporting pieces are respectively positioned at opposing sides of the fixing piece.

Each supporting piece defines a retaining portion. The mounting portion and the retaining portion together is configured for retaining a workpiece therebetween. The receiving notch of the mounting portion is configured for facilitating the positioning of the workpiece.

Other advantages and novel features will become more apparent from the following detailed description when taken in conjunction with the accompanying drawings.

BRIEF DESCRIPTION OF THE DRAWINGS

Many aspects of the present rack apparatus can be better understood with reference to the following drawings. The components in the drawings are not necessarily drawn to scale, the emphasis instead being placed upon clearly illustrating the principles of the present rack apparatus. Moreover, in the drawings, like reference numerals designate corresponding parts through out the several views.

DETAILED DESCRIPTION OF THE INVENTION

Figure 1:
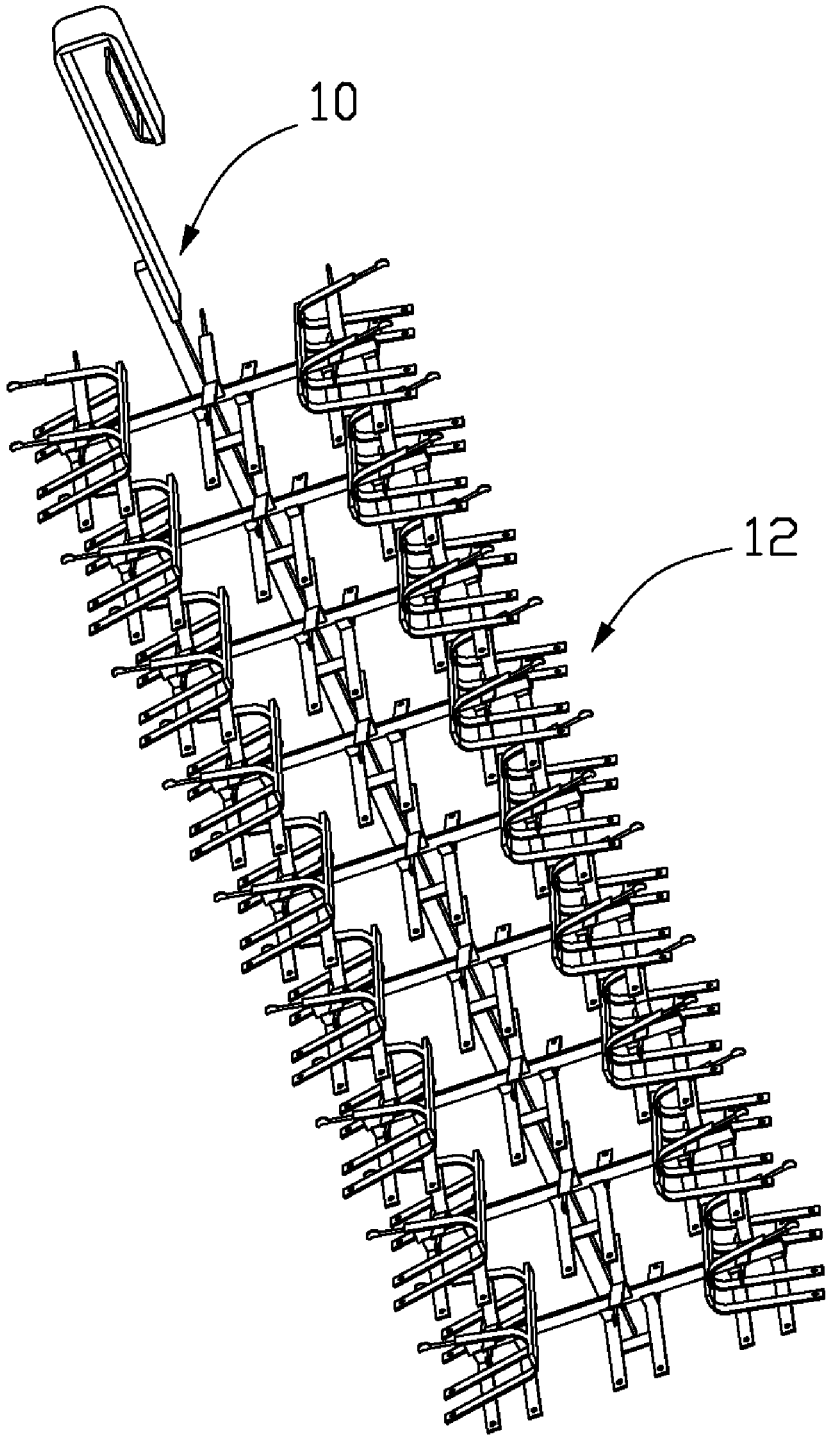
FIG. 1 is a schematic view of a rack apparatus, in accordance with a present embodiment.

Referring now to the drawings in detail, FIG. 1 shows a rack apparatus 100, in accordance with a present embodiment. The rack apparatus 100 includes a frame 10 and a plurality of retaining members 12. The retaining members 12 are, advantageously, arranged on the frame 10 substantially equidistantly to maximize the number of retaining members 12 that can be carried by the frame 10.

Figure 2:
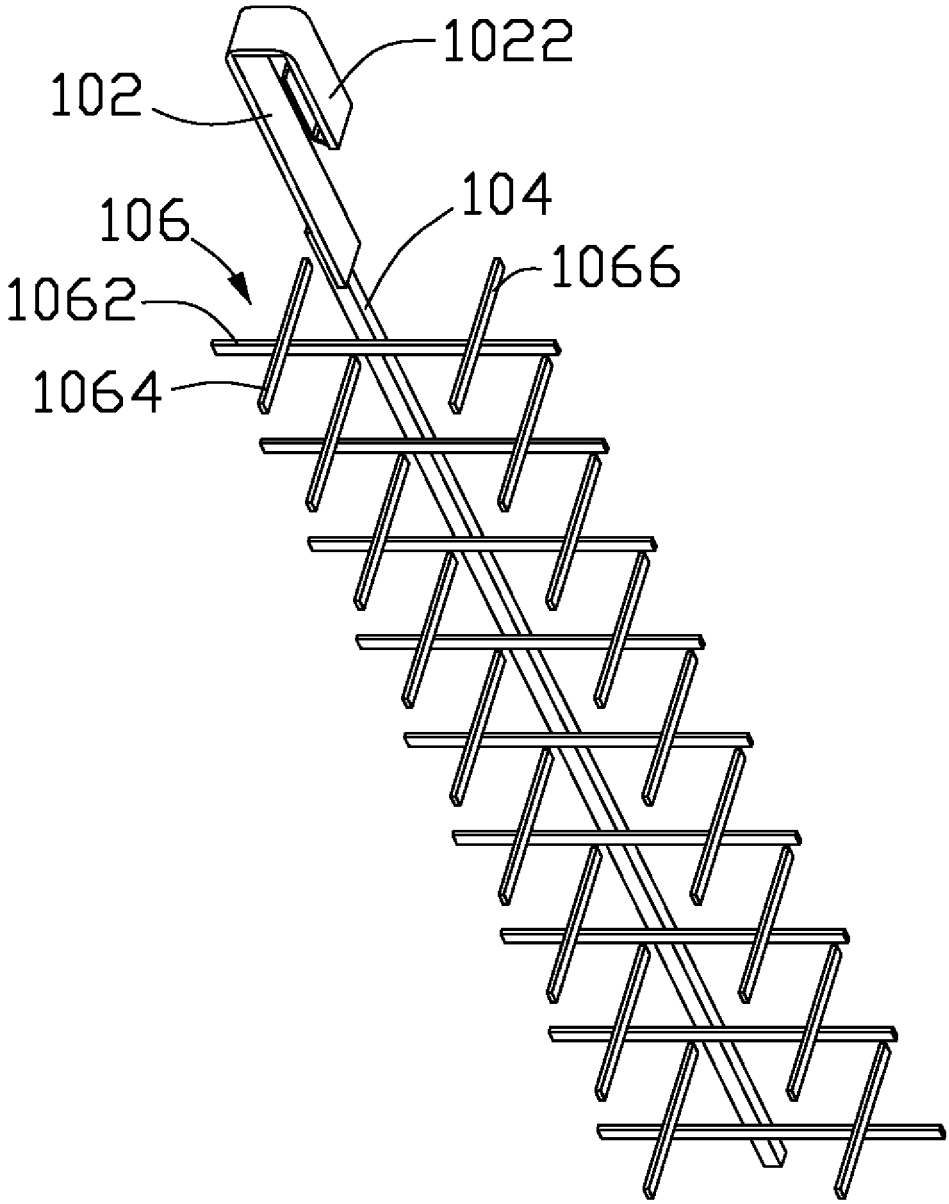
FIG. 2 is a schematic view of a pole member with a plurality of supporting members carried by the rack apparatus shown in FIG. 1.

Referring to FIG. 2, the frame 10 is beneficially made of a mechanically and chemically durable metal, such as a titanium alloy, and includes, at least, a hanging member 102, a pole member 104, and a plurality of support members 106. One end of the hanging member 102 is bent into a hook 1022, and the other end of the hanging member 102 is directly joined (e.g., metallurgically bonded and/or bolted) to the pole member 104. The pole member 104 can be a straight pole. The support members 106 are advantageously arranged in groups thereof to optimize the number of workpieces that can be carried by the frame 10. Each group of support members 106 includes a longer beam 1062 and two shorter beams 1064, 1066. The shorter beams 1064, 1066 are perpendicularly arranged/mounted (e.g., via metallurgical bonding and/or bolting) directly on the longer beam 1062, thereby together forming a cross-bar shape. Each group of support member 106 is approximately perpendicularly mounted (e.g., metallurgically bonded and/or bolted) directly on the pole member 104 at a middle portion of the longer beam 1062.

Figure 3:
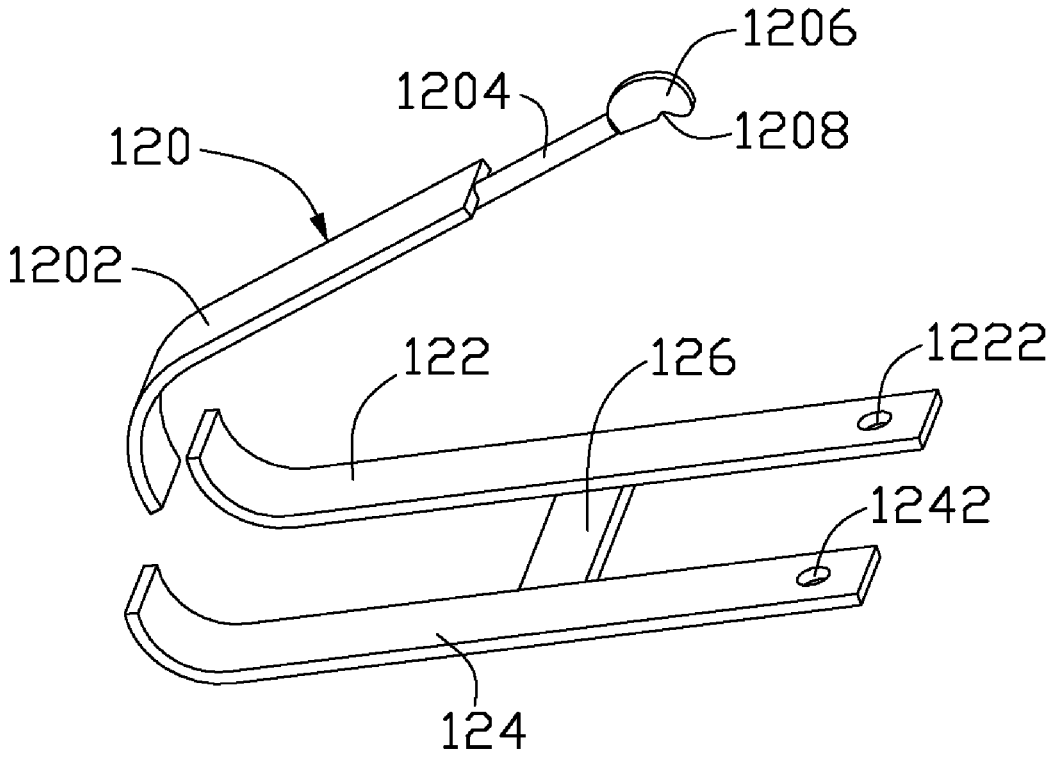
FIG. 3 is an enlarged schematic view of a retaining member shown in FIG. 1.

Referring to FIG. 3, each retaining member 12 is, beneficially, made of a mechanically and chemically durable metal, such as a titanium alloy. Each retaining member 12 includes a fixing piece 120, two supporting pieces 122, 124, and a connecting piece 126. The fixing piece 120 is mounted angled (e.g., 25°~35°) relative to the supporting pieces 122, 124, to facilitate receipt, with a spring bias, of a workpiece therebetween. The fixing piece 120 includes an arm portion 1202, a handle portion 1204, and a mounting portion 1206.

The arm portion 1202 is substantially board-shaped. A distal end of the arm portion 1202 at an opposite end to the handle portion 1204 is bent/curved to be approximately arcuate-shape for promoting the mounting (e.g., via metallurgical bonding and/or bolting) of the fixing piece 120 to the support members 106. The handle portion 1204 is substantially a titanium alloy wire, and one end of the handle portion 1204 forms a workpiece mounting portion 1206. The mounting portion 1206 is flat, substantially semicircular, aligned essentially perpendicular to the arm portion 1202 nearest the handle portion, and defines a receiving gap/notch 1208 in one side thereof. The receiving gap/notch 1208 thereof is located opposite the substantially semicircular curved section of the mounting portion 1206 and generally faces/opens toward the opposing supporting pieces 122, 124. The substantially semicircular curved section of the respective mounting portions 1206 is advantageous in that such a shape reduces the potential for accidentally scratching/abrading other workpieces not held thereby.

A length of the supporting pieces 122, 124 is approximately the same as that of the fixing piece 120. A distal end of each supporting piece 122,124 is bent/curved to be approximately arcuate-shape for promoting mounting (e.g., via metallurgical bonding and/or bolting) of the supporting piece 122, 124 to the support members 106. A distal, free end of each supporting piece 122, 124 defines a through hole 1222, 1242 for fixing a workpiece thereto. The connecting piece 126 is a flat, rectangular board and connects the two supporting pieces 122, 124 together to keep the two supporting pieces 122, 124 properly spaced, to ensure the two supporting pieces 122, 124, act essentially in unison (e.g., gain even deflection during workpiece mounting therewith), and to generally improve the stability of the corresponding support member 106.

Figure 4:
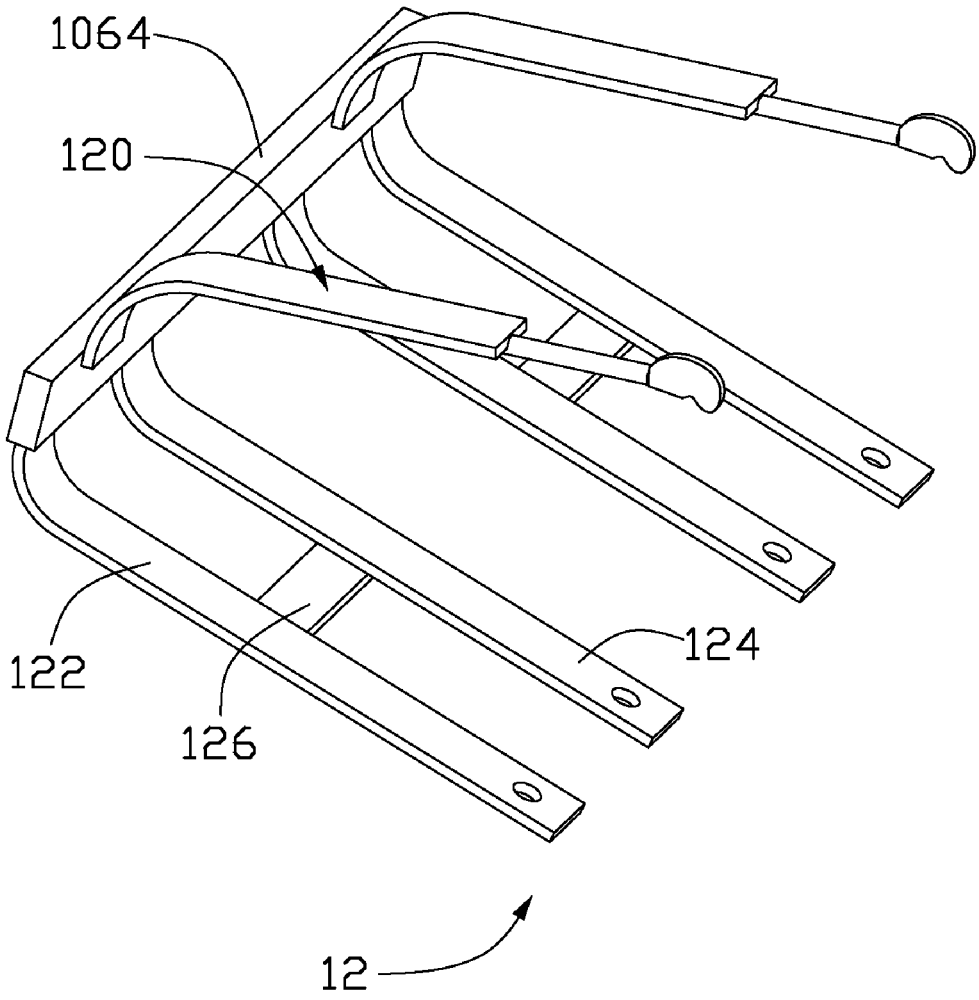
FIG. 4 is an enlarged schematic view of two retaining members assembled on a shorter beam, as shown in FIG. 1.
Figure 5:
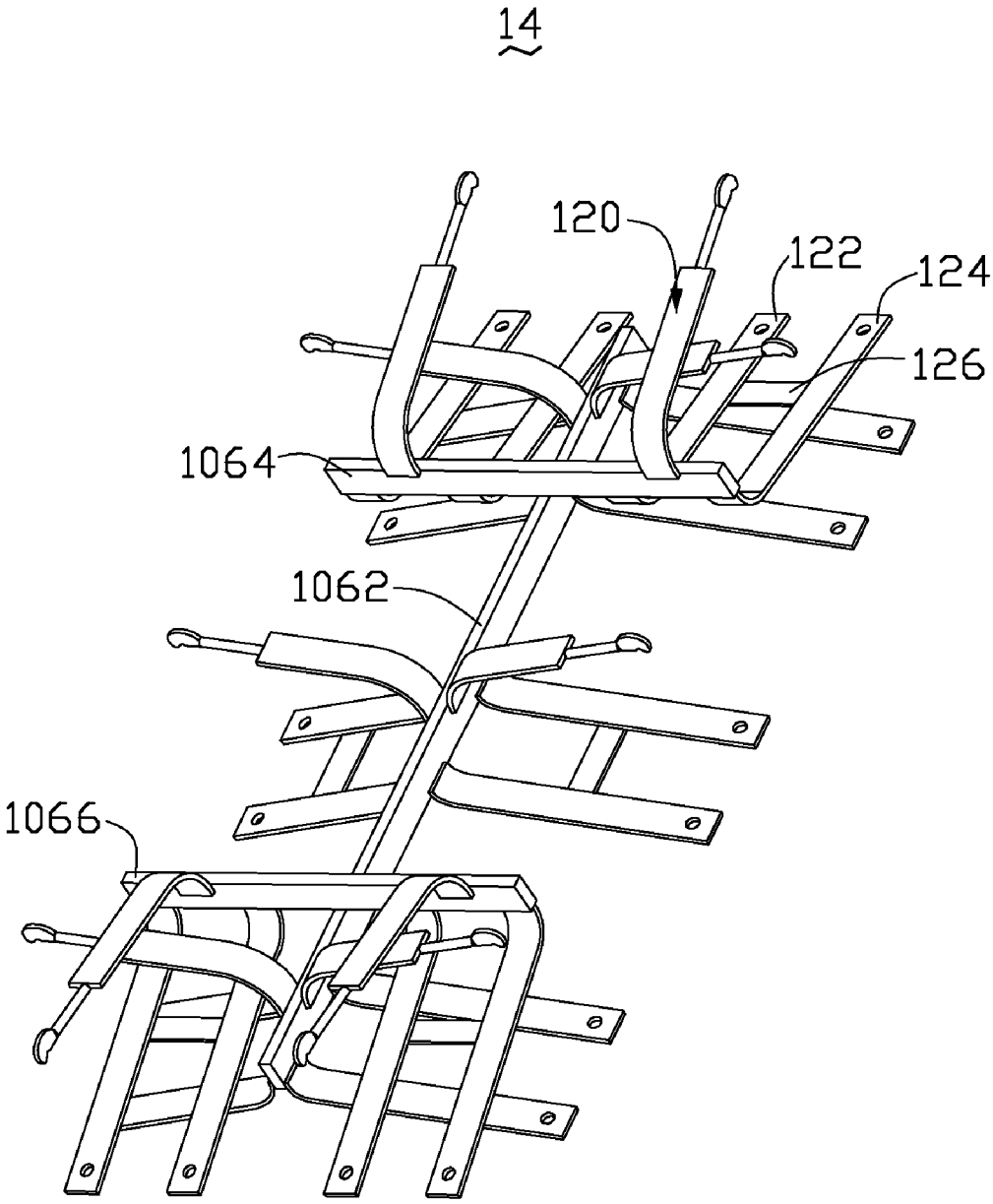
FIG. 5 is an enlarged schematic view of a retaining unit of the rack apparatus shown in FIG. 1.

In assembly, referring to FIGS. 4 and 5, firstly, two retaining members 12 are respectively welded/soldered at/to two ends of the shorter beams 1064. Each retaining member 12 is aligned parallel to another retaining member 12. Similarly, another two retaining members 12 are respectively welded/soldered (i.e., metallurgically bonded) at two ends of the shorter beams 1066. Secondly, six retaining members 12 are respectively welded/soldered to each longer beam 1062, two at each end portion and a pair at a middle portion of the given longer beam 1062. Each retaining member 12 attached to a side of the longer beam 1062 is opposite to another retaining member 12 mounted on another side thereof, in order to maximize the number of retaining members 12 that can be carried on the frame 12. After that, the shorter beams 1064, 1066, with four retaining members 12, are fixed directly (e.g., via a metallurgical bond) to the longer beam 1062. Accordingly, ten retaining members 12, along with the longer beam 1062 and the two shorter beams 1064, 1066, associated therewith, constitute a retaining unit 14. Each retaining unit 14 can be parallel with each retaining unit 14 attached (e.g., via a metallurgical bond) to a same side of the pole member 104, as the more ordered arrangement helps increase retaining member density. Finally, a hanging member 102 is soldered/welded to an end of the pole member 104 so as to finish the assembling process.

Figure 6:
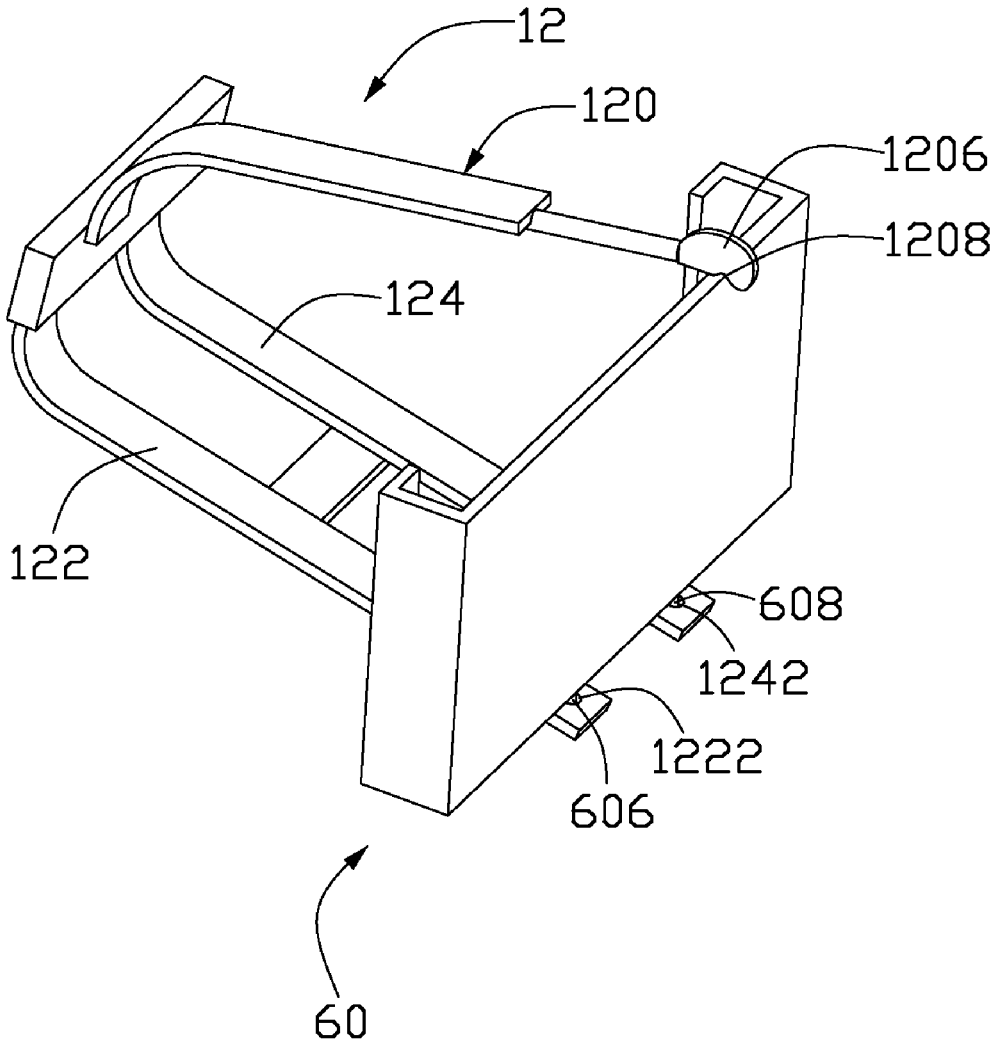
FIG. 6 is a schematic view of the retaining member of FIG. 4, shown in use to retain a workpiece.
Figure 7:
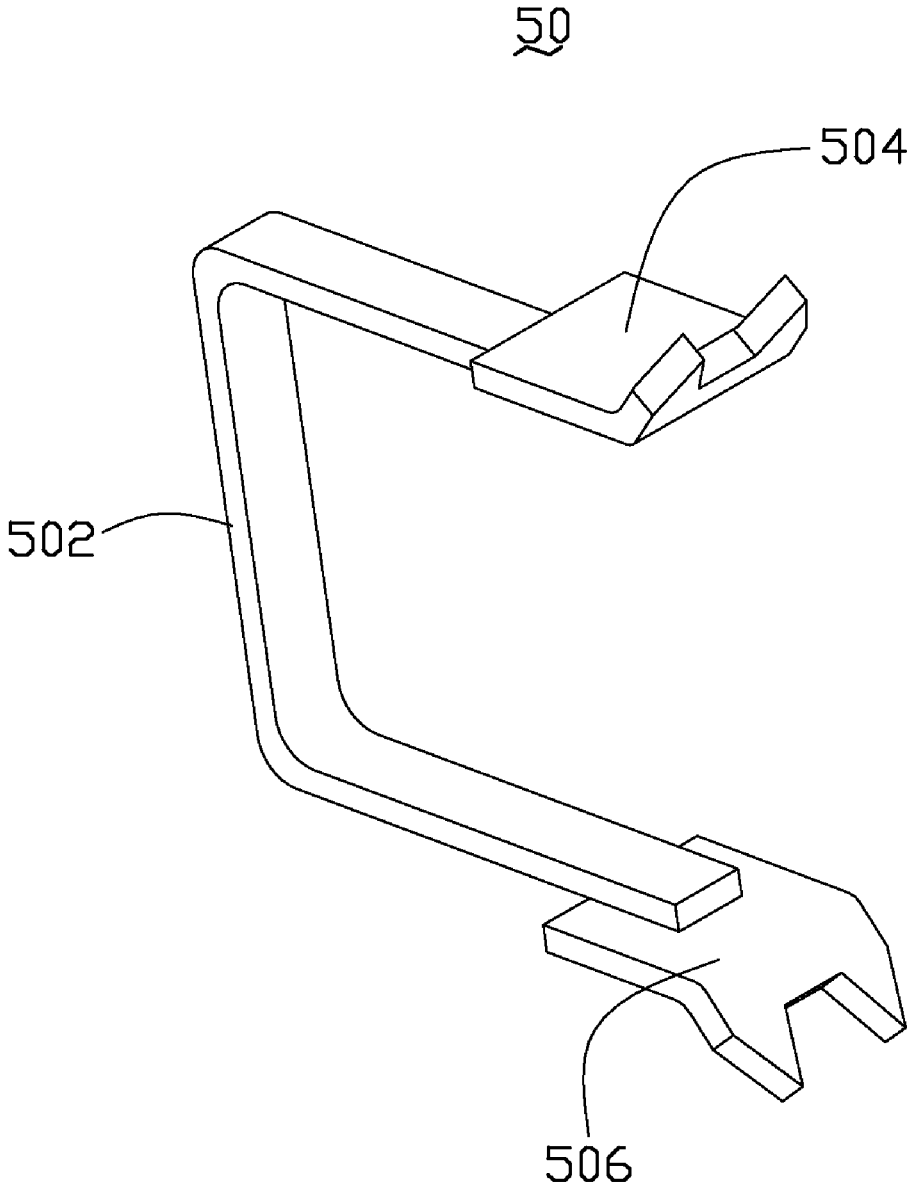
FIG. 7 (PRIOR ART)
FIG. 7 is a schematic view of a retaining member of a typical rack apparatus.
Figure 8:
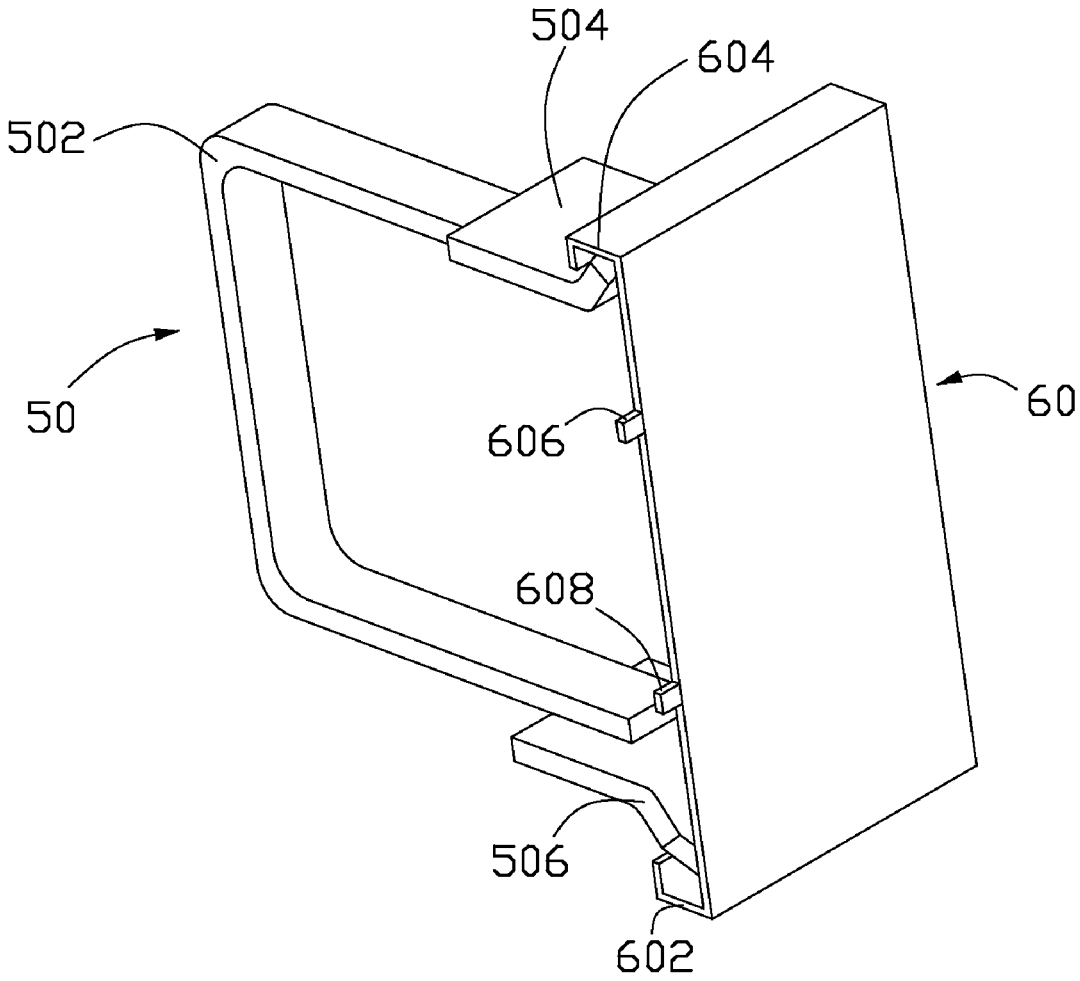
FIG. 8 (PRIOR ART)
FIG. 8 is a schematic view of the retaining member of FIG. 7, shown in use to retain a workpiece.

The rack apparatus 100 is used to retain workpieces 60 during anodizing. Referring to FIG. 6, each workpiece 60 requiring anodizing has two tabs 606, 608 formed at one side thereof. When the rack apparatus 100 is used to hold the workpiece 60 during treatment, each retaining member 12 retains a workpiece 60. The two tabs 606,608 are inserted into a respective through hole 1222, 1242, and the gap/notch 1208 of the mounting portion 1206 receives an opposite edge of the workpiece 60, thereby facilitating the positioning of the workpiece 60. In this way, the workpieces 60 are retained in and by the respective retaining members 12, and thus the rack apparatus 100 with workpieces 60 can be placed into an electroplating container (not shown) for anodizing. After anodizing, the rack apparatus 100 and the workpieces 60 are taken out of the electroplating container, and the workpieces 60 are taken out of the rack apparatus 100.

In this rack apparatus 100, the mounting portion 1206 is formed using titanium alloy wire. In this way, the contact area of the mounting portion 1206 with the workpiece 60 is minimized due to the thinness (e.g., about 0.8 mm~1.5 mm thick) of the mounting portion 1206, thereby facilitating more complete anodizing of a given workpiece 60 (i.e., maximizing the amount of workpiece surface area exposed to the anodizing process). In addition, the fixing piece 120 and the supporting pieces 122, 124 are angled so as to provide a pressing/spring force to fix the workpiece 6 in place. Additionally, the curved/bent mounting sections 1206 of the fixing piece 120 and the supporting pieces 122, 124, help further promote a spring bias therein.

Understandably, the frame 10 and the retaining members 12 can be replaced with other shapes and structures according to differing demands. For example, a plurality of retaining members 12 can be radially mounted on the frame 10. The retaining members 12 can be mounted to the frame 10 directly. The number and position of the retaining members 12 can also be changed. Further, it is to be understood that any number of each of the fixing pieces 120 and the supporting pieces 122, 124, in a given retaining member 12 could be employed (e.g., to accommodate smaller or larger workpieces).

Additionally, each mounting portion 1206 can be of other shapes having a small contacting area with each workpiece 60.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A retaining member, comprising:

a fixing piece having a mounting portion, the mounting portion having a receiving notch therein; and two supporting pieces respectively positioned at an opposite side of the fixing piece, each supporting piece defining a retaining portion, and wherein the fixing piece further includes and arm portion and a handle portion, the handle portion is positioned between the arm portion and the mounting portion, the handle portion is made of a titanium allow wire, and wherein the two supporting pieces are parallel and are connected with a connecting piece, the arm portion is board-shaped, the mounting portion is aligned perpendicular to the arm portion, the mounting portion and the retaining portions being resilient and together being configured for retaining a workpiece by a spring bias caused by the resiliency of the mounting portion and the retaining portions, the receiving notch of the mounting portion being configured for facilitating the positioning of the workpiece.

2. The retaining member as claimed in claim 1, wherein the fixing piece and each supporting piece is made of titanium alloy.

3. The retaining member as claimed in claim 1, wherein the mounting portion has a substantially semicircular curved section, the receiving notch thereof being located opposite the substantially semicircular curved section thereof.

4. The retaining member as claimed in claim 1, wherein the retaining portion of a respective supporting piece is a through hole defined in the respective supporting piece.

5. A rack apparatus, comprising:

a frame; and a plurality of supporting members arranged on the frame; and a plurality of retaining members mounted on the supporting members, each retaining member including:

a fixing piece having a notched mounting portion, wherein each fixing piece further includes a board-shaped arm portion and a handle portion, and the handle portion is positioned between the arm portion and the mounting portion, the handle portion is made of a titanium alloy wire; and two supporting pieces respectively separately positioned at an opposite side of the fixing piece, wherein two ends of a connecting piece are perpendicularly positioned at a halfway point of the two supporting pieces to connect the supporting pieces together each supporting piece defining a retaining portion, the mounting portion and the retaining portions being resilient to elastically clamp a workpiece therebetween.

6. The rack apparatus as claimed in claim 5, wherein the frame includes a hanging member and a pole member, one end of the hanging member is connected to one end of the pole member, and a hook is formed on another end of the hanging member.

7. The rack apparatus as claimed in claim 5, wherein each supporting member includes a longer beam and two shorter beams, the longer beam is perpendicularly bonded to the frame, and the shorter beams are perpendicularly arranged on the longer beam to thereby form a crossbar shape therewith, each longer beam is parallel to each other.

8. The rack apparatus as claimed in claim 5, wherein each fixing piece and each supporting piece is made of titanium alloy.

9. The rack apparatus as claimed in claim 5, wherein each mounting portion has a substantially semicircular curved section, the notched mounting portion having a receiving notch therein, the receiving notch being located opposite the substantially semicircular curved section thereof.

10. The rack apparatus as claimed in claim 5, wherein the retaining portion of a respective supporting piece is a through hole defined in the respective supporting piece.

11. The retaining member as claimed in claim 1, wherein two ends of said connecting piece are perpendicularly positioned at a halfway point of the two supporting pieces to connect the supporting pieces together.

12. The retaining member as claimed in claim 1, wherein distal ends of the arm portion and the supporting pieces are bent to be arcute-shape, and are welded to a group of support members.

13. A rack apparatus, comprising:

a frame; and a plurality of long beams parallel to be arranged on the frame; and two shorter beams being perpendicularly arranged on each of longer beams to thereby form a crossbar shape therewith;

three pairs of retaining members mounted on each of the longer beams, one pair at each end and one pair one at a halfway point of the longer beam's length; one pair of retaining members mounted on two ends of each of the shorter beams, each retaining member including:

a fixing piece having an arm portion, a handle portion and a mounting portion; one end of the arm portion fixed to either a corresponding longer beam or corresponding short beam; and two parallel supporting pieces respectively positioned at an opposite side of the fixing piece, ends of the supporting pieces bonded at the corresponding longer beam or short beam, each supporting piece defining a retaining portion, the mounting portion and the retaining portions together being configured for retaining a workpiece therebetween.

14. The rack apparatus as claimed in claim 13, wherein the arm portion is board-shaped, the handle portion is positioned between the arm portion and the mounting portion, the handle portion is made of a titanium alloy wire, and the mounting portion is aligned perpendicular to the arm portion.

15. The rack apparatus as claimed in claim 13, wherein distal ends of the arm portion and the supporting pieces are bent to be arcute-shape, and are welded to the longer beams or the shorter beams.

* * * * *